US010527327B2

(12) United States Patent
Okada et al.

(10) Patent No.: US 10,527,327 B2
(45) Date of Patent: Jan. 7, 2020

(54) HEAT PUMP

(71) Applicant: Yanmar Co., Ltd., Osaka-shi, Osaka-fu (JP)

(72) Inventors: Hideshi Okada, Osaka (JP); Hirotoshi Kihara, Osaka (JP); Sadanori Yasuda, Osaka (JP); Keisuke Ota, Osaka (JP); Tomoya Yoshimura, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 15/559,019

(22) PCT Filed: Mar. 11, 2016

(86) PCT No.: PCT/JP2016/057841

§ 371 (c)(1),
(2) Date: Sep. 15, 2017

(87) PCT Pub. No.: WO2016/148080

PCT Pub. Date: Sep. 22, 2016

(65) Prior Publication Data

US 2018/0080690 A1 Mar. 22, 2018

(30) Foreign Application Priority Data

Mar. 17, 2015 (JP) ..... 2015-053179

(51) Int. Cl.
*F25B 27/02* (2006.01)
*F25B 49/02* (2006.01)
*F25B 43/00* (2006.01)

(52) U.S. Cl.
CPC ..... *F25B 27/02* (2013.01); *F25B 43/006* (2013.01); *F25B 49/02* (2013.01);
(Continued)

(58) Field of Classification Search
CPC ..... F25B 27/00; F25B 27/02; F25B 43/006; F25B 1/00; F25B 49/02; F25B 2600/2513;
(Continued)

(56) References Cited

U.S. PATENT DOCUMENTS 6,148,632 A 11/2000 Kishita et al.
8,919,139 B2 * 12/2014 Yamada ..... F25B 49/005 62/126
(Continued)

FOREIGN PATENT DOCUMENTS

EP 1731853 12/2006
EP 2787305 A1 10/2014
(Continued)

OTHER PUBLICATIONS

Tomczyk, John, The Professor: Suction Line Accumulators, Oct. 1, 2012, ACHRNEWS (Year: 2012).*
(Continued)

*Primary Examiner* — Edward F Landrum
*Assistant Examiner* — Chang H. Park
(74) *Attorney, Agent, or Firm* — Norton Rose Fulbright US LLP

(57) ABSTRACT

An exemplary heat pump includes: an accumulator that separates liquid refrigerant from gas refrigerant returning to a compressor; a refrigerant suction channel connecting the compressor to the accumulator; a refrigerant return channel that returns liquid refrigerant in the accumulator to the refrigerant suction channel; a first valve disposed on the refrigerant return channel; a temperature sensor that detects a temperature of refrigerant in the refrigerant suction channel; a second valve that reduces a pressure of a part of liquid refrigerant flowing between the first and second heat exchangers; a refrigerant evaporator that gasifies, by using waste heat of an engine, the liquid refrigerant whose pressure has been reduced; a gas refrigerant supply channel through which the gasified refrigerant is supplied to the accumulator; and a control device that, while the first valve is open, controls an opening of the second valve based on the temperature detected by the temperature sensor.

7 Claims, 1 Drawing Sheet

(52) U.S. Cl.
CPC ..... *F25B 2341/0662* (2013.01); *F25B 2600/2513* (2013.01); *F25B 2600/2519* (2013.01); *F25B 2700/21151* (2013.01)

(58) Field of Classification Search
CPC ..... F25B 2600/2519; F25B 2341/0662; F25B 2700/21151; F25B 2500/28; F25B 2700/21175; F25B 40/00; F25B 41/062; Y02A 30/274
USPC ..... 62/208
See application file for complete search history.

(56) References Cited

U.S. PATENT DOCUMENTS

| | | | | |
|---|---|---|---|---|
| 9,518,755 | B2 * | 12/2016 | Toya | F24F 1/0003 |
| 2009/0229285 | A1 * | 9/2009 | Sato | F25B 41/00 62/149 |

FOREIGN PATENT DOCUMENTS

| | | | | |
|---|---|---|---|---|
| JP | 11-278045 | A | | 10/1999 |
| JP | 2003-106609 | A | | 4/2003 |
| JP | 2003106609 | A | * | 4/2003 |
| JP | 2004-245548 | A | | 9/2004 |
| JP | 2005-147437 | A | | 6/2005 |
| JP | 2012-82993 | A | | 4/2012 |
| JP | 2012082993 | A | * | 4/2012 |
| WO | 2013/160966 | A1 | | 10/2013 |

OTHER PUBLICATIONS

Tomczyk, John, The Professor: Troubleshooting Using Compressor Discharge Temp, May 5, 2014, ACHRNEWS (Year: 2014).*

Atkins T, Escudier M. A Dictionary of Mechanical Engineering, 2013, Oxford University Press (Year: 2013).*

International Search Report dated Jun. 7, 2016 issued in corresponding PCT Application PCT/US2016/057841cites the foreign patent documents above.

European Search Report dated Oct. 12, 2018 issued in corresponding European Application No. 16764910.2 cites the patent documents above.

Korean Office Action dated Jan. 21, 2019 issued in corresponding Korean Application No. 10-2017-7025642 cites the patent documents above.

* cited by examiner

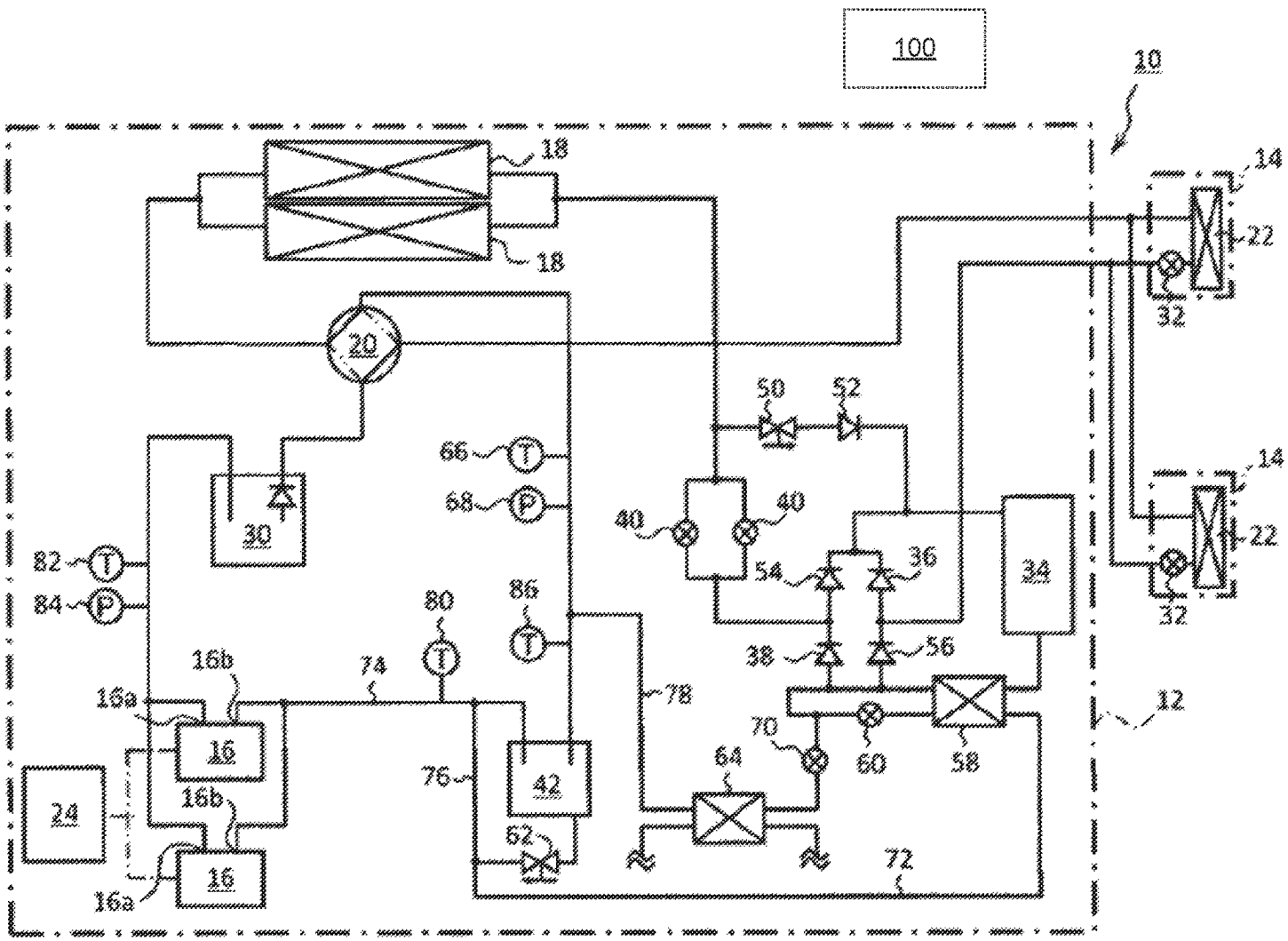
100
10
12
14
14
22
22
32
32
34
36
38
40
40
42
50
52
54
56
58
60
62
64
66
68
70
72
74
76
78
80
82
84
86
16
16
16a
16a
16b
16b
18
18
20
24
30

HEAT PUMP

CROSS REFERENCES TO RELATED APPLICATIONS

This application is a national stage application pursuant to 35 U.S.C. § 371 of International Application No. PCT/JP2016/057841, filed on Mar. 11, 2016, which claims priority under 35 U.S.C. § 119 to Japanese Patent Application No. 2015-053179, filed on Mar. 17, 2015, the disclosures of which are hereby incorporated by reference in their entireties.

TECHNICAL FIELD

The present invention relates to a heat pump.

BACKGROUND ART

A heat pump that has been known to date includes an accumulator disposed near a suction port of a compressor and allows refrigerant returning to the compressor to pass therethrough (e.g., Patent Literature 1, hereinafter referred to as PTL 1). The accumulator separates liquid refrigerant from gas refrigerant returning to the compressor to thereby suppress a flow of the liquid refrigerant into the compressor.

The heat pump described in PTL 1 is configured to gasify liquid refrigerant in the accumulator and return the gasified refrigerant to the compressor. Specifically, the heat pump includes a refrigerant return channel connecting a refrigerant channel between the compressor and the accumulator to a bottom portion of the accumulator. The refrigerant return channel is provided with an expansion valve that reduces the pressure of liquid refrigerant and a heat exchanger that gasifies the liquid refrigerant whose pressure has been reduced by the expansion valve. The heat exchanger gasifies liquid refrigerant whose pressure has been reduced by using high-temperature cooling water of an engine that drives the compressor. In this manner, liquid refrigerant in the accumulator is gasified and returned to the compressor to be reused.

CITATION LIST

Patent Literature

PTL 1: Japanese Patent Application Laid-Open No. 2012-82993

SUMMARY OF INVENTION

Technical Problem

The heat pump described in PTL 1, however, needs a heat exchanger that performs heat exchange between the liquid refrigerant and cooling water of the engine, in order to gasify and reuse liquid refrigerant in the accumulator.

It is therefore an object of an aspects of the present invention to gasify and reuse liquid refrigerant in an accumulator that separates liquid refrigerant from gas refrigerant returning to a compressor in a heat pump without using a heat exchanger that performs heat exchange between the liquid refrigerant in the accumulator and cooling water of an engine.

Solution to Problem

To solve the technical problem described above, an aspect of the present invention provides a heat pump including:

a compressor that compresses refrigerant and discharges the compressed refrigerant;

an engine that drives the compressor;

first and second heat exchangers through which the refrigerant discharged from the compressor passes:

an accumulator that separates liquid refrigerant from gas refrigerant returning to the compressor through the first and second heat exchangers;

a refrigerant suction channel connecting the compressor and the accumulator to each other;

a refrigerant return channel that returns liquid refrigerant stored in a bottom portion of the accumulator to the refrigerant suction channel;

a first valve disposed on the refrigerant return channel, the first valve being a shut-off valve or an expansion valve having an adjustable opening degree;

a temperature sensor that detects a temperature of refrigerant in the refrigerant suction channel at a location closer to the compressor than an intersection point between the refrigerant suction channel and the refrigerant return channel;

a second valve that is an expansion valve having an adjustable opening degree, the second valve configured to reduce a pressure of a part of liquid refrigerant flowing in a refrigerant channel between the first and second heat exchangers;

a refrigerant evaporator that gasifies, by using waste heat of the engine, the part of liquid refrigerant whose pressure has been reduced by the second valve;

a first gas refrigerant supply channel through which gas refrigerant gasified by the refrigerant evaporator is supplied to the accumulator; and a control device that, while the first valve is open, calculates a degree of superheat of refrigerant sucked into the compressor based on the temperature detected by the temperature sensor and controls the opening degree of the second valve based on the degree of superheat of the sucked refrigerant.

Advantageous Effects of Invention

According to an aspect of the present invention, in a heat pump including an accumulator that separates liquid refrigerant from refrigerant returning to a compressor, the liquid refrigerant can be gasified and reused without using a heat exchanger that performs heat exchange between the liquid refrigerant in the accumulator and cooling water of an engine.

BRIEF DESCRIPTION OF DRAWING

[FIG. 1] A circuit diagram illustrating a configuration of a heat pump according to an embodiment of the present invention.

DESCRIPTION OF EMBODIMENTS

An embodiment of the present invention will be described hereinafter with reference to the drawing.

FIG. 1 is a circuit diagram illustrating a configuration of a heat pump according to an embodiment of the present invention. In this embodiment, the heat pump is a heat pump incorporated in an air conditioner. In FIG. 1, solid lines indicate refrigerant channels (refrigerant pipes) in which refrigerant flows. In the circuit diagram illustrated in FIG. 1, components of the heat pump, such as a filter, are not shown for simplicity of description.

As illustrated in FIG. 1, a heat pump 10 includes an outdoor unit 12 that exchanges heat with outdoor air and at least one indoor unit 14 that exchanges heat with indoor air. In this embodiment, the heat pump 10 includes two indoor units 14.

The outdoor unit 12 includes compressors 16 that compress refrigerant and discharge the compressed refrigerant, heat exchangers 18 that perform heat exchange between refrigerant and outdoor air, and a four-way valve 20. On the other hand, each of the indoor units 14 has a heat exchanger 22 that performs heat exchange between refrigerant and indoor air.

The compressors 16 are driven by a gas engine 24. In this embodiment, two compressors 16 and one gas engine 24 are included in the outdoor unit 12. At least one of the compressors 16 is selectively driven by one gas engine 24. The driving source of the compressors 16 is not limited to the gas engine 24, and may be a motor or a gasoline engine, for example.

High-temperature and high-pressure gas refrigerant discharged from discharge ports 16*a* of the compressors 16 is directed to the heat exchangers 18 of the outdoor unit 12 or the heat exchangers 22 of the indoor units 14 by the four-way valve 20. In a heating operation, gas refrigerant discharged from the compressors 16 is sent to the heat exchangers 22 of the indoor units 14. On the other hand, in a cooling operation, the gas refrigerant is sent to the heat exchangers 18 of the outdoor unit 12.

An oil separator 30 that separates oil included in refrigerant is disposed on a refrigerant channel between the discharge ports 16*a* of the compressors 16 and the four-way valve 20.

In the heating operation, the high-temperature and high-pressure gas refrigerant that was discharged from the compressors 16 and passed through the four-way valve 20 (solid lines) exchanges heat with indoor air (temperature adjustment target) in the heat exchanger 22 of at least one of the indoor units 14. That is, heat is transferred from the refrigerant to the indoor air through the heat exchanger 22. Consequently, the refrigerant becomes a low-temperature and high-pressure liquid state.

Each of the indoor units 14 includes an expansion valve 32 whose opening degree is adjustable. The expansion valve 32 is disposed in the indoor unit 14 and is located between the heat exchanger 22 of the indoor unit 14 and the heat exchangers 18 of the outdoor unit 12 on the refrigerant channel. The refrigerant can pass through the heat exchanger 22 of the indoor unit 14 while the expansion valve 32 is open. While the indoor unit 14 stops, the expansion valve 32 is closed. In the heating operation, the expansion valve 32 is fully open.

The outdoor unit 12 includes a receiver 34. The receiver 34 is a buffer tank that temporarily stores low-temperature and high-pressure liquid refrigerant subjected to heat exchange with indoor air in the heat exchangers 22 of the indoor units 14 in the heating operation. The liquid refrigerant that has flowed from the heat exchangers 22 of the indoor units 14 flows into the receiver 34 through a check valve 36.

In the heating operation, the low-temperature and high-pressure liquid refrigerant in the receiver 34 is sent to the heat exchangers 18 of the outdoor unit 12. A check valve 38 and expansion valves 40 are provided on the refrigerant channel between the receiver 34 and the heat exchangers 18. The expansion valves 40 are expansion valves whose opening degrees are adjustable. In the heating operation, the opening degree of each of the expansion valves 40 is adjusted so that a refrigerant temperature detected by a temperature sensor 66 or a temperature sensor 88 is a predetermined degree of superheat or more. The low-temperature and high-pressure liquid refrigerant that has flowed from the receiver 34 is expanded (subjected to pressure reduction) by the expansion valves 40 to be a low-temperature and low-pressure liquid state (mist state).

In the heating operation, the low-temperature and low-pressure liquid refrigerant that has passed through the expansion valves 40 exchanges heat with outdoor air in the heat exchangers 18 of the outdoor unit 12. That is, heat is transferred from the outdoor air to the refrigerant through the heat exchangers 18. Consequently, the refrigerant becomes a low-temperature and low-pressure gas state.

The outdoor unit 12 includes an accumulator 42. In the heating operation, the accumulator 42 temporarily stores low-temperature and low-pressure gas refrigerant after heat exchange with outdoor air in the heat exchangers 18 of the outdoor unit 12. The accumulator 42 is disposed on a refrigerant channel between the suction ports 16*b* of the compressors 16 and the four-way valve 20.

The low-temperature and low-pressure gas refrigerant in the accumulator 42 is sucked in the compressors 16 and is compressed therein. Consequently, the refrigerant becomes a high-temperature and high-pressure gas state, and in the heating operation, is sent to the heat exchangers 22 of the indoor units 14 again.

While the low-temperature and low-pressure gas refrigerant is temporarily stored in the accumulator 42, a small amount of liquid refrigerant included in the gas refrigerant is separated. This liquid refrigerant is stored in the accumulator 42.

On the other hand, in a cooling operation, high-temperature and high-pressure gas refrigerant discharged from the discharge ports 16*a* of the compressors 16 moves to the heat exchangers 18 of the outdoor unit 12 through the four-way valve 20 (indicated by chain double-dashed lines). Through heat exchange with outdoor air in the heat exchangers 18, the gas refrigerant becomes a low-temperature and high-pressure liquid state.

The refrigerant that has flowed from the heat exchangers 18 passes through a shut-off valve 50 and a check valve 52 and flows into the receiver 34. The shut-off valve 50 is closed in the heating operation.

In the cooling operation, refrigerant that has flowed from the heat exchangers 18 flows into the receiver 34 only through the shut-off valve 50 and the check valve 52, and in some cases, additionally through the expansion valves 40 and a check valve 54.

In the cooling operation, the refrigerant that has flowed into the receiver 34 passes through a check valve 56 and then passes through the expansion valves 32 of the indoor units 14. By the passage through the expansion valves 32, the refrigerant is subjected to pressure reduction and becomes a low-temperature and low-pressure liquid state (mist state).

The refrigerant that has passed through the expansion valves 32 passes through the heat exchangers 22 of the indoor units 14 and exchanges heat with indoor air therein. In this manner, the refrigerant takes heat from the indoor air (cools the indoor air). As a result, the refrigerant becomes a low-temperature and low-pressure gas state. The refrigerant that has flowed from the heat exchangers 22 passes through the four-way valve 20 and the accumulator 42, and returns to the compressors 16.

To increase a cooling efficiency, the heat pump 10 includes a cooling heat exchanger (corresponding to a "cooler" in claims) 58 for cooling refrigerant flowing from the receiver 34 toward the check valve 56.

The cooling heat exchanger 58 is configured to perform heat exchange between the liquid refrigerant flowing from the receiver 34 toward the check valve 56 and mist refrigerant, that is, to cool the liquid refrigerant by using the mist refrigerant. This mist refrigerant is obtained by changing part of the liquid refrigerant flowing from the cooling heat exchanger 58 toward the check valve 56 into mist (reducing the pressure of the refrigerant) by using an expansion valve (corresponding to a "third valve" in claims) 60. The expansion valve 60 is a valve whose opening degree is adjustable in order to selectively cool liquid refrigerant by the cooling heat exchanger 58.

When a control device (e.g., 100) of the heat pump 10 controls the expansion valve 60 so that the expansion valve 60 at least partially opens, the liquid refrigerant having passed through the cooling heat exchanger 58 and yet to pass through the check valve 56 partially passes through the expansion valve 60 to be changed into mist (subjected to pressure reduction). The mist refrigerant obtained by the expansion valve 60 flows into the cooling heat exchanger 58, takes heat from the liquid refrigerant that has flowed out of the receiver 34 and yet to pass through the check valve 56, and is thereby gasified. As a result, liquid refrigerant at a temperature lower than that in a state where the expansion valve 60 is closed flows into the heat exchangers 22 of the indoor units 14.

On the other hand, the gas refrigerant that has taken heat from the liquid refrigerant that has flowed out of the receiver 34 and yet to pass through the check valve 56, is returned to a refrigerant suction channel 74 between the compressors 16 and the accumulator 42 from the cooling heat exchanger 58 through a gas refrigerant supply channel (corresponding to a "second gas refrigerant supply channel" in claims) 72.

The gas refrigerant from the cooling heat exchanger 58 is used for evaporating liquid refrigerant stored in a bottom portion of the accumulator 42. Specifically, a refrigerant return channel 76 connecting the refrigerant suction channel 74 to the bottom portion of the accumulator 42 is provided in order to return the liquid refrigerant stored in the bottom portion of the accumulator 42 to the compressors 16. This refrigerant return channel 76 is provided with a shut-off valve (corresponding to a "first valve" in claims) 62. A gas refrigerant supply channel 72 in which the gas refrigerant from the cooling heat exchanger 58 flows is connected to the refrigerant return channel 76. Thus, by opening the shut-off valve 62, the liquid refrigerant that has flowed from the accumulator 42 and is flowing in the refrigerant return channel 76 is mixed with gas refrigerant returning from the cooling heat exchanger 58 to the compressors 16 through the gas refrigerant supply channel 72 to be gasified, and is returned to the compressors 16.

The heat pump 10 also includes an evaporation assisting heat exchanger (corresponding to a "refrigerant evaporator" in claims) 64 for gasifying liquid refrigerant included in gas refrigerant returning from the four-way valve 20 to the compressors 16.

To determine whether the gas refrigerant returning to the compressors 16 includes liquid refrigerant or not, the refrigerant channel between the four-way valve 20 and the accumulator 42 is provided with the temperature sensor 66 and a pressure sensor 68 for detecting the temperature and pressure of the refrigerant. The temperature sensor 66 and the pressure sensor 68 output detection signals corresponding to detection results to the control device (e.g., 100) of the heat pump 10. Based on the detection signals from the temperature sensor 66 and the pressure sensor 68, the control device determines whether liquid refrigerant is included in the gas refrigerant returning to the compressors 16 or not. Specifically, the control device calculates a saturated steam temperature of refrigerant corresponding to the refrigerant pressure detected by the pressure sensor 68, and if the temperature detected by the temperature sensor 66 is greater than or equal to the saturated steam temperature, the control device determines that substantially no liquid refrigerant is included in the gas refrigerant returning to the compressors 16 (i.e., the amount of liquid refrigerant is substantially zero).

The evaporation assisting heat exchanger 64 is disposed on a gas refrigerant supply channel (corresponding to a "first gas refrigerant supply channel" in claims) 78 connecting the refrigerant channel in which liquid refrigerant that has flowed from the receiver 34 and yet to pass through the check valve 38 or 56 flows to the refrigerant channel between the four-way valve 20 and the accumulator 42. This gas refrigerant supply channel 78 is provided with an expansion valve (corresponding to a "second valve" in claims) 70 that expands (reduces the pressure of) liquid refrigerant yet to pass through the evaporation assisting heat exchanger 64 and has an adjustable opening degree.

If the control device (e.g., 100) of the heat pump 10 determines that the gas refrigerant returning to the compressors 16 includes a specified amount or more of liquid refrigerant, the control device controls the expansion valve 70. In this manner, the expansion valve 70 at least partially opens.

When the expansion valve 70 at least partially opens, part of low-temperature and high-pressure liquid refrigerant that has flowed from the receiver 34 and yet to pass through the check valve 56 flows in the expansion valve 70 to be changed into a low-temperature and low-pressure mist state (subjected to pressure reduction).

The mist refrigerant that has passed through the expansion valve 70 is heated in the evaporation assisting heat exchanger 64 by using, for example, a high-temperature exhaust gas or cooling water of the gas engine 24 (i.e., waste heat of the gas engine 24). In this manner, the mist refrigerant that has flowed into the evaporation assisting heat exchanger 64 through the expansion valve 70 is changed into a high-temperature and low-pressure gas state. The high-temperature gas refrigerant heated by the evaporation assisting heat exchanger 64 is supplied to the refrigerant channel between the four-way valve 20 and the accumulator 42. In this manner, liquid refrigerant included in the gas refrigerant that has passed through the four-way valve 20 and returns to the compressors 16 is heated by the high-temperature gas refrigerant from the evaporation assisting heat exchanger 64 and is evaporated (gasified). As a result, refrigerant flowing into the accumulator 42 is substantially caused to be in a gas state. In opening the expansion valve 70, the temperature detected by a temperature sensor 86 that is the temperature of refrigerant merged with refrigerant in the gas refrigerant supply channel 78 is used as a temperature used for determining whether the gas refrigerant returning to the compressors 16 includes liquid refrigerant or not.

The foregoing description is schematically directed to components of the heat pump 10 related to refrigerant. Hereinafter, control of the shut-off valve 62 by the control device of the heat pump 10 will be described.

The shut-off valve 62 for returning liquid refrigerant stored in the bottom portion of the accumulator 42 to the compressors 16 is generally held in an open state. To hold the shut-off valve 62 in the open state, it is necessary to continuously maintain refrigerant flowing in the refrigerant return channel 76 in a gas state. To maintain this state, gas refrigerant is supplied from the cooling heat exchanger 58 to the refrigerant return channel 76 through the gas refrigerant supply channel 72, and gas refrigerant is supplied from the evaporation assisting heat exchanger 64 to the accumulator 42 through the gas refrigerant supply channel 78.

The flow rate of the gas refrigerant supplied from the cooling heat exchanger 58 to the refrigerant return channel 76 through the gas refrigerant supply channel 72 is adjusted by the expansion valve 60, and the flow rate of the gas refrigerant flowing from the evaporation assisting heat exchanger 64 to the accumulator 42 through the gas refrigerant supply channel 78 is adjusted by the expansion valve 70. The opening degrees of the expansion valves 60 and 70 are adjusted based on the temperature detected by a temperature sensor 80 that detects the temperature of refrigerant in the refrigerant suction channel 74.

Specifically, the temperature sensor 80 detects the temperature of refrigerant in the refrigerant suction channel 74 at a location closer to the compressors 16 than an intersection point between the refrigerant suction channel 74 and the refrigerant return channel 76. Based on the detected temperature of the temperature sensor 80, the control device of the heat pump 10 calculates the degree of superheat of refrigerant sucked into the compressors 16. The degree of superheat of the refrigerant is calculated based on the pressure detected by the pressure sensor 68 that detects the pressure of refrigerant between the four-way valve 20 and the accumulator 42. Specifically, the degree of superheat refers to a temperature difference between a saturated steam temperature of refrigerant corresponding to the detected pressure (i.e., steam pressure) of the pressure sensor 68 and the detected temperature of the temperature sensor 80.

The control device of the heat pump 10 controls the opening degrees of the expansion valves 60 and 70 in such a manner that the degree of superheat of the refrigerant sucked into the compressors 16 is maintained at a level higher than a predetermined degree of superheat (the lower limit of the degree of superheat of the sucked refrigerant). In this manner, refrigerant that has flowed from the accumulator 42 and is flowing in the refrigerant return channel 76 is kept in a gas state. Consequently, gas refrigerant is sucked into the compressors 16.

The shut-off valve 62 is closed only in a case where there is a possibility that liquid refrigerant returns from the accumulator 42 to the compressors 16 through the refrigerant return channel 76. For example, the shut-off valve 62 is closed in a case where the degree of superheat of the refrigerant in the refrigerant suction channel 74 calculated based on the detected temperature of the temperature sensor 80 as described above does not exceed the lower limit of the degree of superheat of the refrigerant.

The shut-off valve 62 is also closed in a case where the degree of superheat of refrigerant discharged from the compressors 16 does not exceed a predetermined degree of superheat (the lower limit of the degree of superheat of the discharged refrigerant), for example. The degree of superheat of the refrigerant discharged from the compressors 16 is calculated based on detection results of a temperature sensor 82 that detects the temperature of refrigerant and a pressure sensor 84 that detects the pressure of the refrigerant on the refrigerant channel between the compressors 16 and the oil separator 30

Furthermore, the shut-off valve 62 is closed in a case where the degree of superheat of refrigerant after a merge of refrigerant flowing from the four-way valve 20 to the accumulator 42 and refrigerant flowing from the evaporation assisting heat exchanger 64 to the accumulator 42 does not exceed a predetermined degree of superheat (the lower limit of the degree of superheat of merged refrigerant). This degree of superheat is calculated based on detection results of the temperature sensor 86 that detects the temperature of refrigerant between an intersection point between the refrigerant channel between the four-way valve 20 and the accumulator 42 and the gas refrigerant supply channel 78 and the accumulator 42 and the pressure sensor 68 that detects the pressure of refrigerant between the intersection point and the four-way valve 20.

That is, the shut-off valve 62 is closed in a case where there is a possibility that liquid refrigerant returns from the accumulator 42 to the compressors 16 even when gas refrigerant is supplied from the cooling heat exchanger 58 to the refrigerant return channel 76 or when gas refrigerant is supplied from the evaporation assisting heat exchanger 64 to the accumulator 42. In this manner, a flow of liquid refrigerant into the compressors 16 can be suppressed.

In the configuration of the embodiment described above, the heat pump 10 can gasify liquid refrigerant in the accumulator and reuse the gasified refrigerant without using a heat exchanger that performs heat exchange between the liquid refrigerant and cooling water of the engine.

The present invention has been described using the embodiment, but is not limited to the embodiment described above.

For example, in the above embodiment, the shut-off valve 62 is disposed on the refrigerant return channel 76 through which liquid refrigerant stored in the bottom portion of the accumulator 42 returns to the compressors 16, but may be replaced by an expansion valve whose opening degree is adjustable. In this case, liquid refrigerant that has flowed from the accumulator 42 into the refrigerant return channel 76 is subjected to pressure reduction by the expansion valve and is further gasified (as compared to the case of using the shut-off valve 62) with gas refrigerant supplied from the cooling heat exchanger 58 to the refrigerant return channel 76 through the gas refrigerant supply channel 72.

In addition, for example, supply of gas refrigerant from the cooling heat exchanger 58 to the refrigerant return channel 76 and supply of gas refrigerant from the evaporation assisting heat exchanger 64 to the accumulator 42 do not need to be performed at the same time. That is, both the expansion valves 60 and 70 do not need to be open at the same time. Specifically, as long as the degree of superheat of refrigerant in the refrigerant suction channel 74 calculated based on the detected temperature of the temperature sensor 80 exceeds the lower limit of the degree of superheat of the refrigerant, at least one of the expansion valves 60 and 70 may be closed or both the expansion valves 60 and 70 may be closed.

For example, in the above embodiment, the heat pump 10 is an air conditioner that controls the temperature of indoor air as a temperature adjustment target, but the embodiment of the present invention is not limited to this example. The heat pump according to the embodiment of the present invention may be a chiller that controls the temperature of water by using refrigerant. A heat pump according to an aspect of the present invention broadly includes: a compressor that compresses refrigerant and discharges the compressed refrigerant; an engine that drives the compressor; first and second heat exchangers through which the refrigerant discharged from the compressor passes: an accumulator that separates liquid refrigerant from gas refrigerant returning to the compressor through the first and second heat exchangers; a refrigerant suction channel connecting the compressor and the accumulator to each other; a refrigerant return channel that returns liquid refrigerant stored in a bottom portion of the accumulator to the refrigerant suction channel; a first valve disposed on the refrigerant return channel, the first valve being a shut-off valve or an expansion valve having an adjustable opening degree; a temperature sensor that detects a temperature of refrigerant in the refrigerant suction channel at a location closer to the compressor than an intersection point between the refrigerant suction channel and the refrigerant return channel; a second valve that is an expansion valve having an adjustable opening degree, the second valve configured to reduce a pressure of a part of liquid refrigerant flowing in a refrigerant channel between the first and second heat exchangers; a refrigerant evaporator that gasifies, by using waste heat of the engine, the part of liquid refrigerant whose pressure has been reduced by the second valve; a first gas refrigerant supply channel through which gas refrigerant gasified by the refrigerant evaporator is supplied to the accumulator; and a control device that, while the first valve is open, calculates a degree of superheat of refrigerant sucked into the compressor based on the temperature detected by a temperature sensor and controls the opening degree of the second valve based on the degree of superheat of the sucked refrigerant.

The present invention is applicable to a heat pump including an accumulator that separates liquid refrigerant from refrigerant returning to a compressor.

The present disclosure has been fully described in relation to a preferred embodiment with reference to the accompanying drawing, but it is obvious for those skilled in the art to which the present invention pertains that various modifications and changes are possible. Such modifications and changes, unless they depart from the scope of the present invention as set forth in claims attached hereto, shall be understood as to be encompassed by the present invention.

The disclosed contents of the specification, drawing, and claims of Japanese Patent Application Laid-Open No. 2015-53179 filed on Mar. 17, 2015 are incorporated herein by reference in its entirety.

REFERENCE SIGNS LIST

10 heat pump
16 compressor
18 heat exchanger
22 heat exchanger
24 engine (gas engine)
42 accumulator
58 cooler (cooling heat exchanger)
60 third valve (expansion valve)
62 first valve (shut-off valve)
64 refrigerant evaporator (evaporation assisting heat exchanger)
70 second valve (expansion valve)
72 second gas refrigerant supply channel (gas refrigerant supply channel)
74 refrigerant suction channel
76 refrigerant return channel
78 first gas refrigerant supply channel (gas refrigerant supply channel)
80 temperature sensor

The invention claimed is:

1. A heat pump comprising:

a compressor configured to compress refrigerant and discharge the compressed refrigerant;

an engine configured to drive the compressor;

first and second heat exchangers configured such that refrigerant discharged from the compressor passes through the first and second heat exchangers;

an accumulator configured to separate liquid refrigerant from gas refrigerant returning to the compressor through the first and second heat exchangers;

a refrigerant suction channel connecting the compressor and the accumulator to each other;

a refrigerant return channel connected to the refrigerant suction channel at a connection location and configured to supply liquid refrigerant stored in a bottom portion of the accumulator to the refrigerant suction channel;

a first valve disposed on the refrigerant return channel, the first valve being a shut-off valve or an expansion valve having an adjustable opening;

a first temperature sensor configured to detect a temperature of refrigerant in the refrigerant suction channel at a location that is downstream of the connection location between the refrigerant suction channel and the refrigerant return channel;

a second valve that is an expansion valve having an adjustable opening, the second valve configured to reduce a pressure of a portion of liquid refrigerant that flows between the first and second heat exchangers;

a refrigerant evaporator configured to gasify, using waste heat of the engine, liquid refrigerant whose pressure has been reduced by the second valve;

a first gas refrigerant supply channel configured to supply refrigerant gasified by the refrigerant evaporator to the accumulator; and a controller configured to:

calculate a degree of superheat of refrigerant in the refrigerant suction channel based on a temperature detected by the first temperature sensor;

while the first valve is open, adjust the opening of the second valve based on the degree of superheat of refrigerant; and based on the degree of superheat of refrigerant i-s being less than or equal to a predetermined degree of superheat, close the first valve.

2. The heat pump according to claim 1, further including:

a third valve that is different from the second valve, the third valve being:

an expansion valve having an adjustable opening; and the third valve configured to reduce a pressure of a portion of liquid refrigerant that flows between the first and second heat exchangers;

a cooler configured to receive and gasify liquid refrigerant whose pressure has been reduced by the third valve by using the received liquid refrigerant to cool other liquid refrigerant; and a second gas refrigerant supply channel configured to supply refrigerant gasified by the cooler to the refrigerant return channel, wherein, while the first valve is open, the third valve is configured to adjust the opening of the third valve based on the degree of superheat.

3. The heat pump of claim 1, wherein the first valve is a shut-off valve.

4. The heat pump according to claim 1, further comprising:

a second temperature sensor configured to detect a temperature of refrigerant in a refrigerant channel between a four-way valve and the accumulator; and a second pressure sensor configured to detect a pressure of refrigerant in the refrigerant channel between the four-way valve and the accumulator.

5. The heat pump according to claim 4, further comprising:

a third temperature sensor configured to detect a temperature of refrigerant in a refrigerant channel between the compressor and an oil separator; and a third pressure sensor configured to detect a pressure of refrigerant in the refrigerant channel between the compressor and the oil separator.

6. The heat pump according to claim 5, wherein:

a degree of superheat of refrigerant in the refrigerant channel is based on the temperature detected by the second temperature sensor and the pressure detected by the second pressure sensor; and a degree of superheat of refrigerant in the refrigerant channel is based on the temperature detected by the third temperature sensor and the pressure detected by the third pressure sensor.

7. The heat pump according to claim 1, wherein first temperature sensor is configured to detect the temperature of refrigerant in the refrigerant suction channel at a location closer to the compressor than the connection location between the refrigerant suction channel and the refrigerant return channel.

* * * * *